US006995671B2

(12) United States Patent
Dutta et al.

(10) Patent No.: US 6,995,671 B2
(45) Date of Patent: Feb. 7, 2006

(54) MAILBOX STATUS SYSTEM AND METHOD

(75) Inventors: Rabindranath Dutta, Los Angeles, CA (US); Kumar Ravi, Cedar Park, TX (US); Eduardo N. Spring, Round Rock, TX (US)

(73) Assignee: International Business Machines Corporation, Armonk, NY (US)

( * ) Notice: Subject to any disclaimer, the term of this patent is extended or adjusted under 35 U.S.C. 154(b) by 769 days.

(21) Appl. No.: 10/047,117

(22) Filed: Jan. 15, 2002

(65) Prior Publication Data

US 2003/0134620 A1 Jul. 17, 2003

(51) Int. Cl.
*G08B 13/14* (2006.01)

(52) U.S. Cl. ..... 340/569; 232/17

(58) Field of Classification Search ..... 455/414.1; 340/569; 232/37

See application file for complete search history.

(56) References Cited

U.S. PATENT DOCUMENTS 4,520,350 A * 5/1985 Huang ..... 340/569
4,651,135 A * 3/1987 Duhaime et al. ..... 340/569
4,872,210 A * 10/1989 Benages ..... 340/569
5,023,595 A * 6/1991 Bennett ..... 340/569
5,036,310 A * 7/1991 Russell ..... 340/569
5,177,780 A 1/1993 Kasper et al.
5,239,305 A * 8/1993 Murphy et al. ..... 340/539.1
5,313,515 A 5/1994 Allen et al.
5,434,907 A 7/1995 Hurst et al.
5,802,466 A 9/1998 Gallant et al.
6,006,087 A 12/1999 Amin
6,014,559 A 1/2000 Amin
6,028,517 A * 2/2000 Sansone et al. ..... 340/569
6,032,039 A 2/2000 Kaplan
6,114,959 A * 9/2000 Bennett ..... 340/569
6,181,928 B1 1/2001 Moon
6,237,027 B1 5/2001 Namekawa
6,307,472 B1 * 10/2001 Robertson ..... 340/569
6,462,659 B1 * 10/2002 Schuette ..... 340/569

* cited by examiner

*Primary Examiner*—Fan Tsang
*Assistant Examiner*—Simon Sing
(74) *Attorney, Agent, or Firm*—Mark S. Walker; Streets & Steele; Frank J. Campigotto

(57) ABSTRACT

A method, apparatus and program for notifying an electronic address of the presence of physical mail in a designated mailbox is provided. The presence of at least one piece of mail in the mailbox is detected and an electronic notification is transmitted to the address indicating the presence of the at least one piece of mail.

13 Claims, 3 Drawing Sheets

120

| MB # | Message address |
|---|---|
| 1 | joe@aol.com |
| 2 | mary@speedie.net |
| 3 | 512-555-0123 |

MAILBOX STATUS SYSTEM AND METHOD

FIELD OF THE INVENTION

The present invention relates to a system method and product for notifying a user that physical mail items are present in a designated mail box.

BACKGROUND OF THE INVENTION

Just about everyone receives physical mail, as opposed to electronic mail, either at their home or at a designated post office box. The traditional mailbox sits near the owner's home where it is filled by the mail person and emptied by the owner at the owner's leisure. However, many people live in communities or apartments that require the mail to be delivered to a central location. Others choose to have their mail delivered to a post office box.

A great number of communities have installed these centrally located mail boxes a distance from homes. Thus requiring the owners to make a special trip, often times in a car, to the mail box to retrieve mail. With this design, there is no convenient way to determine if there is any mail in a given mailbox. In addition, some of these systems are sent up with separate large boxes for holding large parcels. The mailbox owner is given a key to open the large box and retrieve their parcel.

When mail is delivered to one of these boxes, it is impossible for the owner of the box to know whether there is mail in the box. In addition, if a large package is expected, there is no way of knowing when the package is actually in a designated box. Therefore, there is a need for a means to notify a mailbox owner, remotely, of the presence of mail in the owner's box.

SUMMARY OF THE INVENTION

One aspect of the present invention provides a method for notifying an electronic address of the presence of physical mail in a designated mailbox. The presence of at least one piece of mail in the mailbox is detected and an electronic notification is transmitted to the address indicating the presence of the at least one piece of mail. The term mail is used herein to mean letters as well as parcels.

Another aspect of the present invention provides a method for managing a mailbox. The presence and absence of at least one physical mail piece in the mailbox is detected electronically, generating a detection event. The detection event is transmitted to an electronic address.

Yet another aspect of the present invention provides an apparatus including at least one mailbox, having an electronic address associated therewith, wherein the mailbox is adapted to receive at least one physical piece of mail. A detecting means is associated with the mailbox. The detecting means is adapted to detect the presence and absence of the at least one physical piece mail in the mailbox and transmit signals indicating the presence or absence of mail in the mail box. A processing means receives the signals from the detecting means and a notifying means notifies the address of the presence of mail in the mail box.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figures 1, 1A:
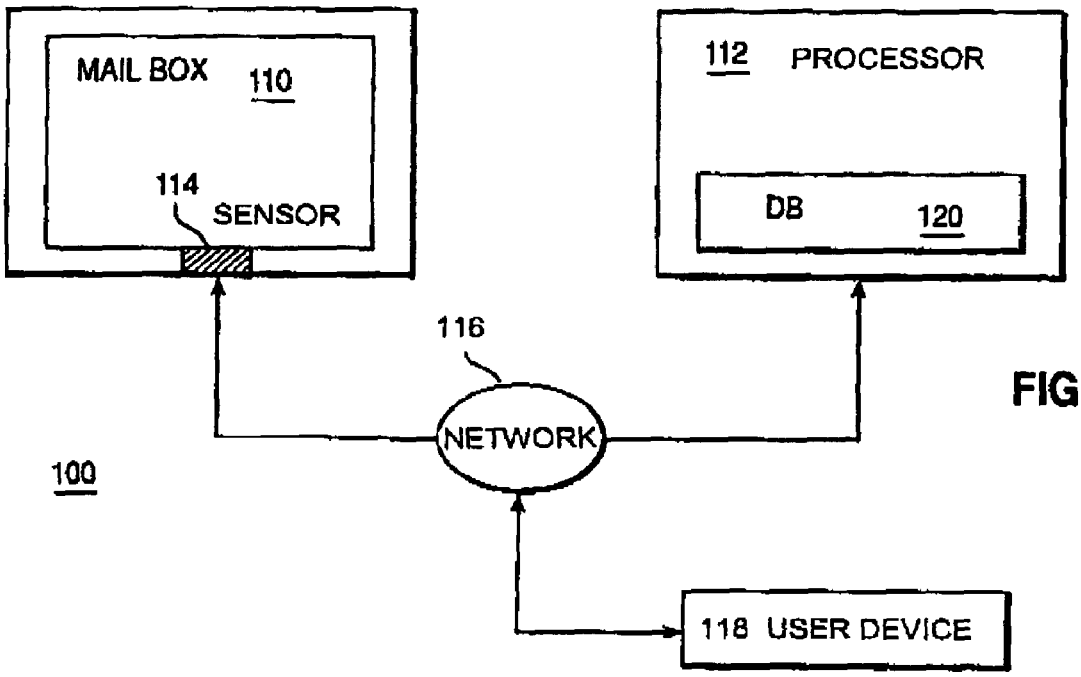
FIG. 1 is a block diagram of a network suitable for use in the present invention.
FIG. 1A is a block diagram of the components found in an exemplary database shown in FIG. 1.

The present invention relates to an apparatus, method and computer program for managing a mailbox designed to receive physical pieces of mail. The apparatus, method and program include a means for detecting mail in a given mailbox and a processing means for sending an electronic notification to a designated address associated with the mailbox when at least one piece of mail is placed in the mailbox. In particular, each mailbox number is mapped to an electronic address that is read by the processing means. The detection of mail may be carried out by electronic sensors and/or a manual device that is activated by a postal worker when mail is placed in a given mailbox.

The processing means includes suitable programming means for carrying out the present invention. The processing means is coupled for data communications with a network, enabling the transfer of a message to the electronic address when mail is detected in a given mailbox. The detecting means may also include a means for weighing the one or more mail pieces in the mailbox. The weight information is communicated to the processing means where it is used to determine if an electronic message should be sent to the electronic address.

Suitable programming means include any means for directing a computer system to execute the steps of the method of the invention, including for example, systems comprised of processing units and arithmetic-logic circuits coupled to computer memory, which systems have the capability of storing in computer memory, which computer memory includes electronic circuits configured to store data and program instructions, programmed steps of the method of the invention for execution by a processing unit. The invention also may be embodied in a computer program product, such as a diskette or other recording medium, for use with any suitable data processing system.

Embodiments of a computer program product may be implemented by use of any recording medium for machine-readable information, including magnetic media, optical media, or other suitable media. Persons skilled in the art will immediately recognize that any computer system having suitable programming means will be capable of executing the steps of the method of the invention as embodied in a program product. Persons skilled in the art will recognize immediately that, although most of the exemplary embodiments described in this specification are oriented to software installed and executing on computer hardware, nevertheless, alternative embodiments implemented as firmware or as hardware are well within the scope of the present invention.

"Coupled for data communications" means any form of data communications, wireless, infrared, radio, internet protocols, HTTP protocols, email protocols, networked, direct connections, dedicated phone lines, dial-ups, serial connections with RS-232 or Universal Serial Buses, hard-wired parallel port connections, and other forms of data communications as will occur to those of skill in the art.

Couplings for data communications wireless modems using analog cellular channels, and communications using CDPD, Cellular Digital Packet Data. Couplings for data communications include wireless access points, wireless network ports according to IEEE standard 802.11, and Bluetooth piconet ports as standardized by the Bluetooth Special Interest Group, and HomeRF ports as standardized by the HomeRF Working Group, as well as infrared ports. Couplings for data communications include Bluetooth piconets implemented in accordance with the well known de facto industry standard known as the "Bluetooth Specification," a specification for short range radio links among mobile personal computers, mobile phones, and other portable devices.

The term "network" is used in this specification to mean any networked coupling for data communications. Examples of networks useful with the invention include intranets, extranets, internets, local area networks, wide area networks, and other network arrangements as will occur to those of skill in the art. The use of any networked coupling among mailbox monitoring systems and e-mail accounts coupled through designated network addresses is well within the scope of the present invention. In embodiments of the kind illustrated, the monitoring system typically includes devices implemented as automated computing machinery, a Web browser, and an internet client having a network address. There is no requirement within the present invention that the Internet client have any particular kind of network address.

"Network address" means any network address useful to locate a particular e-mail account or a designated network address on any network. Network address includes any internet protocol address useful to locate an internet client, a browser, or a designated network address on the Internet. Network addresses useful with various embodiments of the invention include local internet protocol addresses, private internet protocol addresses, and temporary Internet addresses assigned to a Web client by a DHCP server, and permanent, official registered Internet addresses associated with domain names.

Turning now to FIG. 1, there is depicted a block diagram of a network environment 100 in which the present invention may be implemented. While the present invention is described with reference to one type of network environment, it will be understood by one with skill in the art that the present invention may be implemented in alternate types of network environments. Mailbox 110 is coupled for data communications with processing means 112 by network 116. Network 116 also couples client device 118 for data communications with processing means 112. Mailbox 110 comprises a sensor 114 that is adapted to detect the presence of at least one piece of mail in the box. Sensor 114 may be any type of commercially available sensor for detecting movement and/or weight of items in the box. Examples of suitable sensors include but are not limited to IR sensors, weight sensors, or something a simple as a button that the postal worker presses when mail is deposited in a mailbox. If weight is not required, the sensor may be mounted anywhere in the mailbox. Address information for the mailbox owner's is stored in database 120. Database 120 is shown as being resident in processing means 112, however, it should be noted that this database and the notification functions of processing means 112 may be carried out on a third party device remote from the mailbox 110.

FIG. 1A is a block diagram displaying an example of the contents of database 120 shown in FIG. 1. The database contains a listing of each mailbox number and the corresponding network address for sending electronic notifications. In an alternative embodiment, the database may also contain preferences for each mailbox, such as notify me only when my mail reaches a certain weight, eg. 5 ounces. Other preferences may include monitoring the mailbox during specified periods of time during the day, eg. check for mail shortly after the normal scheduled delivery time.

One of ordinary skill in the art will recognize that the initial set up of the system may be done in a variety of ways. For example, the customer may enter their information and preferences in an on-line form, at the post office, over the phone or in person. The administration of the instructions, likewise may be carried out in a variety of ways all of which would be obvious to one of ordinary skill in the art. The postal worker my take written instructions and program the processing means on-site to map to each mailbox or the system may be programmed remotely. The postal worker mail also activate the system manually by pressing a button, entering a character string, or otherwise transmitting a signal to the designated electronic address for a given mailbox.

Figure 2:
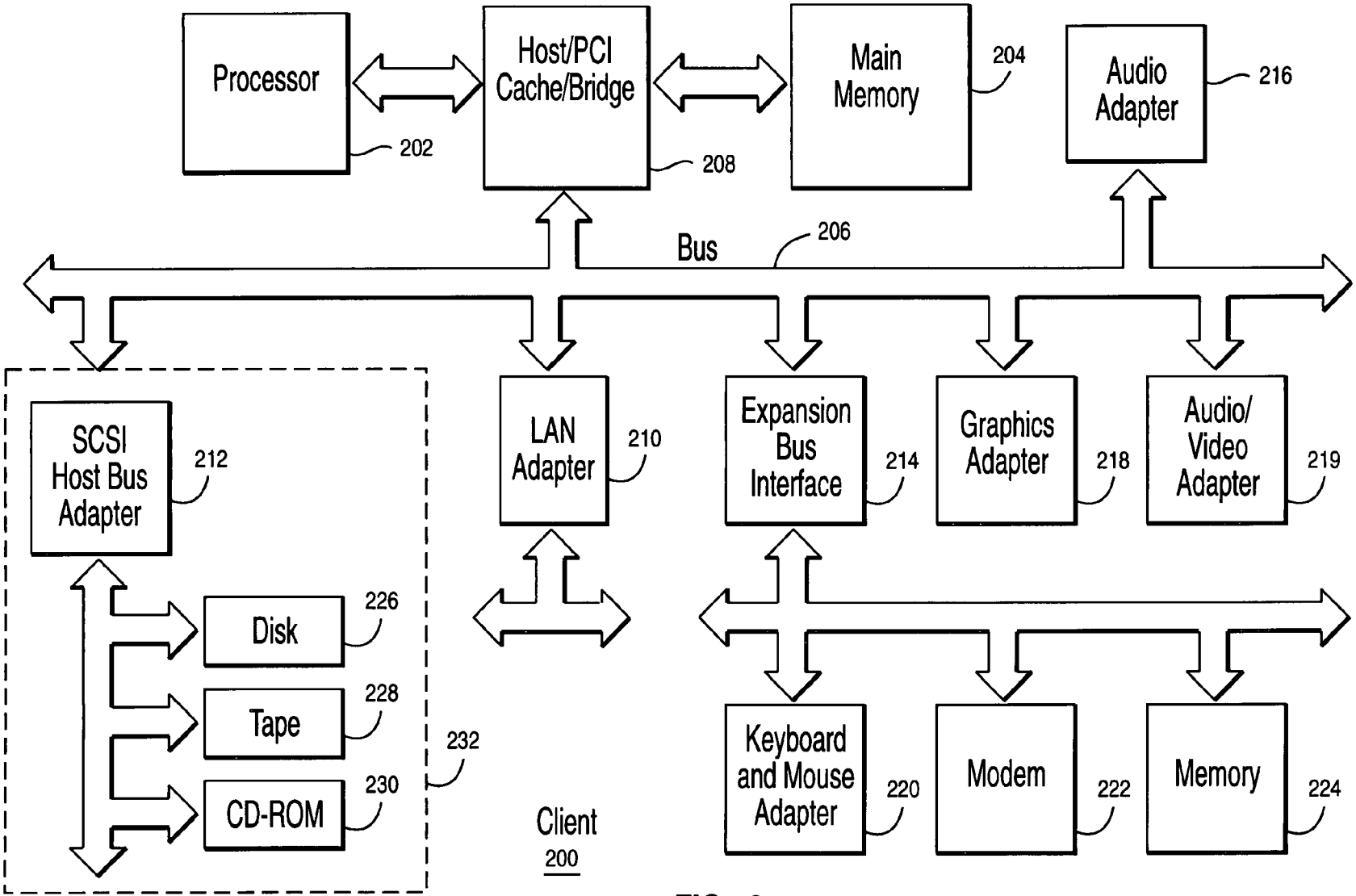
FIG. 2 is a block diagram of components found in FIG. 1.

With reference now to FIG. 2, a block diagram of a data processing system is shown in which the present invention may be implemented. Data processing system 200 is an example of a computer, such as processing means 112 in FIG. 1, in which code or instructions implementing the processes of the present invention may be located. Data processing system 200 employs a peripheral component interconnect (PCI) local bus architecture. Although the depicted example employs a PCI bus, other bus architectures such as Accelerated Graphics Port (AGP) and Industry Standard Architecture (ISA) may be used. Processor 202 and main memory 204 are connected to PCI local bus 206 through PCI bridge 208. PCI bridge 208 also may include an integrated memory controller and cache memory for processor 202. Additional connections to PCI local bus 206 may be made through direct component interconnection or through add-in boards. In the depicted example, local area network (LAN) adapter 210, small computer system interface (SCSI) host bus adapter 212, and expansion bus interface 214 are connected to PCI local bus 206 by direct component connection. In contrast, audio adapter 216, graphics adapter 218, and audio/video adapter 219 are connected to PCI local bus 206 by add-in boards inserted into expansion slots. Expansion bus interface 214 provides a connection for a keyboard and mouse adapter 220, modem 222, and additional memory 224. SCSI host bus adapter 212 provides a connection for hard disk drive 226, tape drive 228, and CD-ROM drive 230. Typical PCI local bus implementations will support three or four PCI expansion slots or add-in connectors.

An operating system runs on processor 202 and is used to coordinate and provide control of various components within data processing system 200 in FIG. 2. The operating system may be a commercially available operating system such as Windows 2000, which is available from Microsoft Corporation. An object oriented programming system such as Java may run in conjunction with the operating system and provides calls to the operating system from Java programs or applications executing on data processing system 200. "Java" is a trademark of Sun Microsystems, Inc. Instructions for the operating system, the object-oriented programming system, and applications or programs are located on storage devices, such as hard disk drive 226, and may be loaded into main memory 204 for execution by processor 202.

Those of ordinary skill in the art will appreciate that the hardware in FIG. 2 may vary depending on the implementation. Other internal hardware or peripheral devices, such as flash ROM (or equivalent nonvolatile memory) or optical disk drives and the like, may be used in addition to or in place of the hardware depicted in FIG. 2. Also, the processes of the present invention may be applied to a multiprocessor data processing system.

For example, data processing system 200, if optionally configured as a network computer, may not include SCSI host bus adapter 212, hard disk drive 226, tape drive 228, and CD-ROM 230, as noted by dotted line 232 in FIG. 2 denoting optional inclusion. In that case, the computer, to be properly called a client computer, must include some type of network communication interface, such as LAN adapter 210, modem 222, or the like. As another example, data processing system 200 may be a stand-alone system configured to be bootable without relying on some type of network communication interface, whether or not data processing system 200 comprises some type of network communication interface. As a further example, data processing system 200 may be a personal digital assistant (PDA), which is configured with ROM and/or flash ROM to provide nonvolatile memory for storing operating system files and/or user-generated data.

The depicted example in FIG. 2 and above-described examples are not meant to imply architectural limitations. For example, data processing system 200 also may be a notebook computer or hand held computer in addition to taking the form of a PDA. Data processing system 200 also may be a kiosk or a Web appliance.

The processes of the present invention are performed by processor 202 using computer implemented instructions, which may be located in a memory such as, for example, main memory 204, memory 224, or in one or more peripheral devices 226–230.

Figure 3:
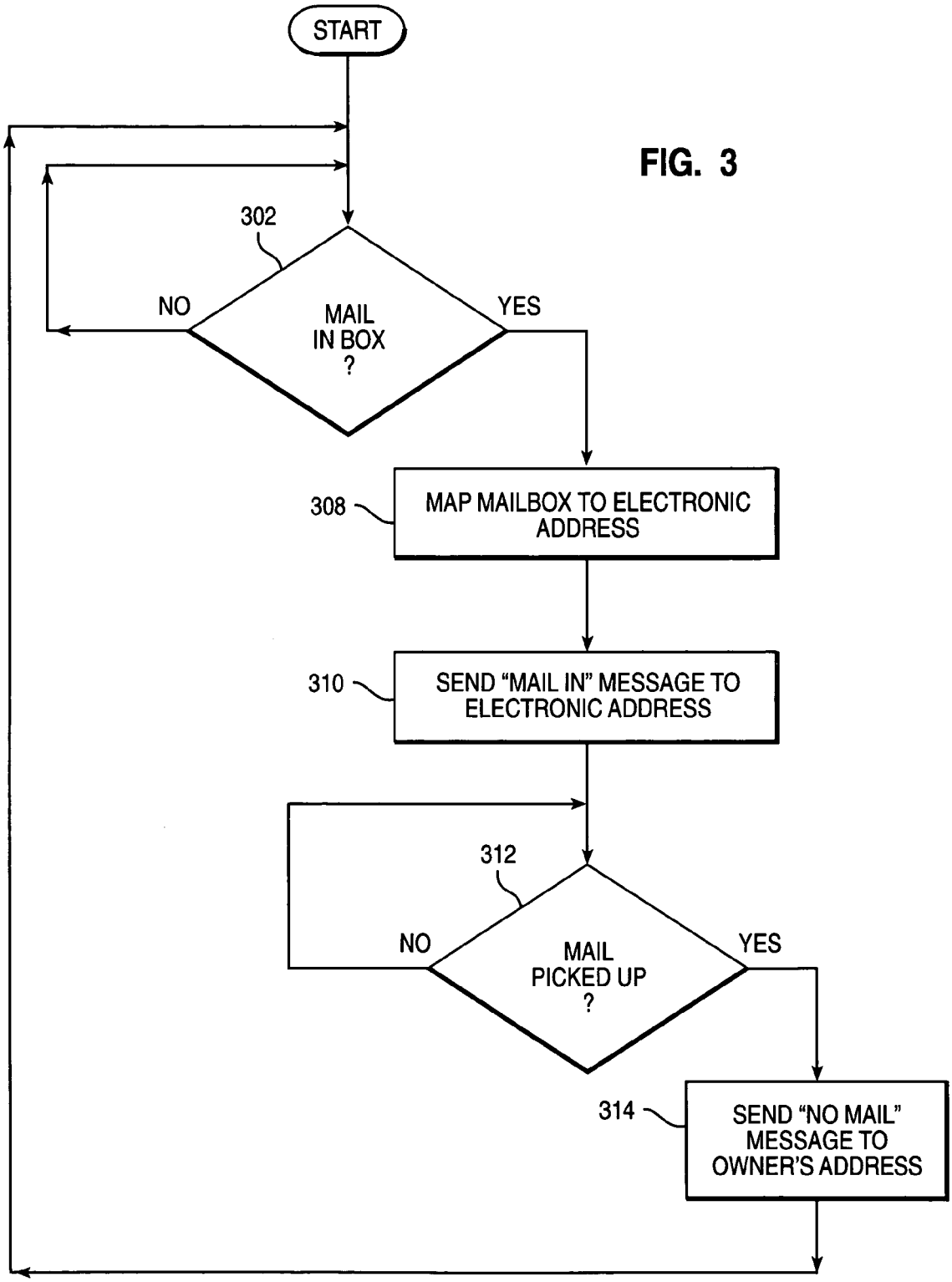
FIG. 3 is a flow chart illustrating the steps taken in one embodiment of the present invention.

FIG. 3 is a flow diagram of an exemplary process of the present invention. The process is described with reference to one mailbox, it should be noted that the process applies to one or multiple mailboxes linked to the processing means. The process starts by checking if there is mail in a mailbox, step 302. If there is no mail in the box, then the process cycles back to step 302. If there is mail in the mailbox, then the process maps the mailbox to the owner's address, step 308. The process then sends an electronic message to the owner's address stating "mail in", step 310. The process then checks the mailbox to see if the mail has been removed, step 312. If the mail has been removed, then the process sends a message to the mailbox owner stating "no mail", step 314. From step 314, the process cycles back to step 302. If the mail has not been picked up, then the process cycles back to step 312, where the process checks to see if mail has been removed from the box.

In an alternative embodiment, the mechanism to detect the delivered mail uses a sensor installed in the bottom of each mailbox. The sensor is communicatively connected to a processing means. The processing means can be installed in close proximity to each mailbox center or in a remote location. The sensor may be manually activated by the postal worker or activated automatically upon the detection of mail in a mailbox.

The processing means may be programmed by a postal worker to program it to manage at least three tasks: 1—Map the box number to an electronic address that is provided by the box owner; 2—Notify the box owner if a mail is delivered; 3—Set up the customer's preferences of mail delivery. Examples of preferences may include but are not limited to if any mail was delivered then notify the customer or notify the box owner only if the weight of the delivered mail is more than 5 grams, etc.

The sensor preferably is adapted to sense the weight of the delivered mail. When mail is placed in a given mailbox the sensor communicates this information to the processing means. The processing means device then maps the box number to an electronic address and sends an electronic notification to that address. The electronic address can be a cell phone number, a pager number, an email address, or any other suitable address.

When the box owner picks up mail in a given mailbox, the sensor communicates this information to the processing means and a notification is sent to the owner's address to let him/her know that the mail was removed from the mailbox.

The processing means may be programmed locally or accessed remotely to enter preferences and other customer information for each mailbox. The mailbox owner may enter their preferences any number of ways, including through a graphical user interface over the Internet, via telephone, other electronic means, or in person.

The present invention provides advantages over prior art systems in that mailbox owners do not have to physically check a mailbox everyday to determine if mail is present. They simple wait for an electronic notification that alerts them to the presence of mail in a given box. This system may also be applied to the scenario where a large parcel is placed in a separate box for the recipient to pick up. When the postal worker places the key in the recipient's mailbox, they may enter a special code or sequence to indicate this information in an electronic message to the designated address. Thus notifying the owner that a package has been delivered. This service may be provided for a fee by the postal service or a third party vendor to the consumer.

It is important to note that while the present invention has been described in the context of a fully functioning data processing system, those of ordinary skill in the art will appreciate that the processes of the present invention are capable of being distributed in the form of a computer readable medium of instructions and a variety of forms and that the present invention applies equally regardless of the particular type of signal bearing media actually used to carry out the distribution. Examples of computer readable media include recordable-type media, such as a floppy disk, a hard disk drive, a RAM, CD-ROMs, DVD-ROMs, and transmission-type media, such as digital and analog communications links, wired or wireless communications links using transmission forms, such as, for example, radio frequency and light wave transmissions. The computer readable media may take the form of coded formats that are decoded for actual use in a particular data processing system.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated

We claim:

1. A method for notifying an electronic address of the presence of physical mail in a designated mailbox, comprising:

detecting at least one piece of mail in the mailbox;

mapping the mailbox to the electronic address;

detecting a weight of the at least one piece of mail in the mailbox;

determining whether to send a notification to the address based on the weight information; and if so determined by the determining step, transmitting an electronic notification to the address indicating the presence of the at least one piece of mail in the mailbox.

2. The method of claim 1, further comprising:

storing preferences associated with the mailbox, wherein the preferences comprise a specified weight to be detected before executing the step of transmitting an electronic notification; and receiving an instruction that defines the specified weight as one of the stored preferences.

3. The method of claim 1, further comprising:

receiving an indication that at least one piece of mail has been placed in an alternate mailbox;

transmitting an electronic notification to the address indicating the presence of the at least one piece of mail placed in the alternate mailbox.

4. The method of claim 3, wherein the electronic notification further indicates that the at least one piece of mail placed in the alternate mailbox comprises a parcel.

5. The method of claim 1, wherein the detecting is performed electronically.

6. An apparatus for notifying an electronic address of the presence of physical mail in the designated mailbox, comprising:

at least one mailbox, wherein the mailbox is adapted to receive at least one physical piece of mail;

a detecting means associated with the mailbox, wherein the detecting means is adapted to detect the weight of the at least one physical piece mail in the mailbox;

a transmitting means associated with the detecting means, wherein the transmitting means is adapted to transmit signals indicating the weight of mail in the mailbox; and a processing means for receiving the signals from the detecting means and for determining whether to send a notification to the address based on the weight information.

7. The apparatus of claim 6, further comprising:

memory adapted for storing preferences associated with the mailbox, wherein the preferences comprise a specified weight to be detected before executing the step of transmitting an electronic notification; and an input device to receive an instruction from an end user that defines the specified weight as one of the stored preferences.

8. The apparatus of claim 6, wherein the detecting means is electronically activated.

9. The apparatus of claim 6, wherein the detecting means is manually activated.

10. The apparatus of claim 6, further comprising:

a receiving means to receive an indication that at least one piece of mail has been placed in an alternate mailbox, wherein transmitting means transmits an electronic notification to the address indicating the presence of the at least one piece of mail placed in the alternate mailbox.

11. A computer program product comprising a computer usable medium including computer usable program code for notifying an electronic address of the presence of physical mail in a designated mailbox, the computer program product comprising:

computer usable program code for detecting at least one piece of mail in the mailbox;

computer usable program code for mapping the mailbox to the electronic address;

computer usable program code for detecting a weight of the at least one piece of mail in the mailbox;

computer usable program code for determining whether to send a notification to the address based on the weight information; and computer usable program code for transmitting an electronic notification to the address indicating the presence of the at least one piece of mail in the mailbox.

12. The computer program product of claim 11, further comprising:

computer usable program code for storing preferences associated with the mailbox, wherein the preferences comprise a specified weight to be detected before executing the step of transmitting an electronic notification; and computer usable program code for receiving an instruction that defines the specified weight as one of the stored preferences.

13. The computer program product of claim 11, further comprising:

computer usable program code for receiving an indication that at least one piece of mail has been placed in an alternate mailbox;

computer usable program code for transmitting an electronic notification to the address indicating the presence of the at least one piece of mail placed in the alternate mailbox.

* * * * *